US010152868B1

(12) United States Patent
Warren et al.

(10) Patent No.: US 10,152,868 B1
(45) **Date of Patent: *Dec. 11, 2018**

(54) SMART BEDTIME

(71) Applicant: Vivint, Inc., Provo, UT (US)

(72) Inventors: Jeremy B. Warren, Draper, UT (US); Matthew J. Eyring, Provo, UT (US); James E. Nye, Alpine, UT (US)

(73) Assignee: Vivint, Inc., Provo, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/852,426

(22) Filed: Dec. 22, 2017

Related U.S. Application Data

(63) Continuation of application No. 14/680,747, filed on Apr. 7, 2015, now Pat. No. 9,858,788.

(51) Int. Cl.
*G08B 21/22* (2006.01)
*G08B 21/02* (2006.01)
*G08B 25/08* (2006.01)

(52) U.S. Cl.
CPC ..... *G08B 21/02* (2013.01); *G08B 21/22* (2013.01); *G08B 25/08* (2013.01)

(58) Field of Classification Search
CPC .... G08B 21/06; G08B 21/0269; G08B 21/22; G08B 21/24; G08B 21/0423; G08B 25/00; H04L 12/2816
USPC ..... 340/539.1, 539.11, 575, 573.1
See application file for complete search history.

(56) References Cited

U.S. PATENT DOCUMENTS

| | | | | |
|---|---|---|---|---|
| 5,692,215 | A | 11/1997 | Kutzik et al. | |
| 6,151,529 | A | 11/2000 | Batko | |
| 7,868,757 | B2 * | 1/2011 | Radivojevic | A61B 5/11 340/540 |
| 8,680,991 | B2 | 3/2014 | Tran | |
| 8,810,388 | B2 | 8/2014 | Jacobs et al. | |
| 9,652,959 | B2 * | 5/2017 | Warren | G08B 19/00 |
| 2006/0015347 | A1 | 1/2006 | Tylicki et al. | |
| 2011/0015467 | A1 | 1/2011 | Dothie et al. | |
| 2011/0102173 | A1 | 5/2011 | Husain | |
| 2014/0266669 | A1 | 9/2014 | Fadell et al. | |
| 2014/0313032 | A1 | 10/2014 | Sager et al. | |
| 2015/0069915 | A1 | 3/2015 | Ogawa et al. | |
| 2015/0156031 | A1 | 6/2015 | Fadell | |
| 2015/0350848 | A1 | 12/2015 | Eramian | |
| 2016/0100696 | A1 | 4/2016 | Palashewski et al. | |
| 2017/0033944 | A1 * | 2/2017 | Nadathur | H04L 12/2816 |

OTHER PUBLICATIONS

Withings Aura, obtained from http://www.withings.com/eu/withings-aura.html#, on Mar. 2, 2015.

* cited by examiner

*Primary Examiner* — Hung T Nguyen
(74) *Attorney, Agent, or Firm* — Holland & Hart, LLP

(57) ABSTRACT

A method for security and/or automation systems is described. In one embodiment, the method may include receiving occupancy data, identifying characteristics of the occupancy data, determining an occupant's location relative to the premises at a predetermined time, and generating a notification based at least in part on the determining.

19 Claims, 7 Drawing Sheets

SMART BEDTIME

CROSS-REFERENCE TO RELATED APPLICATIONS

The present application is a continuation of U.S. patent application Ser. No. 14/680,747, filed Apr. 7, 2015, now U.S. Pat. No. 9,858,788 titled "SMART BEDTIME," and assigned to the assignee hereof, the disclosure of which is expressly incorporated herein in its entirety by this reference.

BACKGROUND

The present disclosure, for example, relates to security and/or automation systems. Security and automation systems are deployed to provide various types of communication and functional features such as monitoring, communication, notification, and/or others. These systems may be capable of supporting communication with a user through a communication connection or a system management action.

Automation systems automate one or more activities related to a premises, such as home and/or a business. Security and/or automation systems, however, may leave an occupant uninformed regarding the status of elements of the security and/or automation system, and/or other occupants at certain times, including at night or at bedtime.

SUMMARY

The disclosure herein includes methods and systems for improving the monitoring of and actions related to several aspects of a premises at night, including bedtime, and keeping one or more occupants apprised of the status of other occupants and/or one or more elements of the automated system at a designated time, among other things. The system may inform a parent regarding the status of each child such as whether they are in bed on time, whether they are home, their current location if they are not home, their estimated return time, etc., among other things. The system may also inform an adult regarding another adult's status such as whether he/she is in bed on time, whether he/she is home, the adult's current location if he/she is not home, his/her estimated return time, etc., among other things.

A method for security and/or automation systems is described. In one embodiment, the method may include receiving occupancy data, identifying characteristics of the occupancy data, determining an occupant's location relative to the premises at a predetermined time, and/or generating a notification based at least in part on the determining.

In some embodiments, identifying characteristics of the occupancy data may include learning at least one of a sleep pattern and/or an occupancy pattern for at least one occupant of the premises. In some cases, the notification may include one, two, or more selectable options. In some cases, the selectable options may include at least a first option to generate a second notification upon detecting the occupant entering the premises and/or a second option to delay the second notification until a later time. In some cases, the notification may include an identification chime. In some cases, the identification chime may be uniquely associated with the occupant.

In some embodiments, the method may include determining whether the occupant is in a room, such as a bedroom, by the predetermined time. In some cases, upon determining the occupant is not in the bedroom by the predetermined time, the method may include generating a notification. In some cases, upon determining the occupant is in the bedroom by or after the predetermined time, the method may include monitoring a sleep parameter of the occupant. In some cases, upon detecting a sleep irregularity of the occupant, the method may include generating a notification.

In some embodiments, the method may include adjusting an aspect of an electrically powered device at the predetermined time to signal a bedtime and/or another event. In some cases, adjusting the aspect of the electrically powered device may include adjusting a brightness level, adjusting a volume level, playing a sound, and/or turning the electrically powered device on and/or off. In some cases, the method may include generating a summary notification. In some cases, the summary notification may include a status of a security system, a status of an automation system, a status of the occupant, a status of a climate control system, a status of an appliance, and/or a status of a vehicle, among other things.

In some cases, upon detecting an irregularity in at least one of the security system, the automation system, the climate control system, the appliance, and/or the vehicle, the method may include including in the summary notification a prompt to adjust one or more aspects of the affected system, appliance, and/or vehicle. In some cases, the method may include monitoring a status of an automated device at the premises. The automated device may include at least one of a light, a door, a window, a lock, an appliance, a computing device, and/or a vehicle, among other things. In some embodiments, upon determining the status of the automated device indicates a predefined irregularity, the method may include generating a notification.

An apparatus for security and/or automation systems is also described. In some embodiments, the apparatus may include a processor, memory in electronic communication with the processor, and instructions stored in the memory, the instructions being executable by the processor to perform the steps of receiving occupancy data, identifying characteristics of the occupancy data, determining an occupant's location relative to the premises at a predetermined time, and/or generating a notification based at least in part on the determining, among other things.

A non-transitory computer-readable medium is also described. The non-transitory computer readable medium may store computer-executable code, the code being executable by a processor to perform the steps of receiving occupancy data, identifying characteristics of the occupancy data, determining an occupant's location relative to the premises at a predetermined time, and/or generating a notification based at least in part on the determining, among other things.

The foregoing has outlined rather broadly the features and technical advantages of examples according to this disclosure so that the following detailed description may be better understood. Additional features and advantages will be described below. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein—including their organization and method of operation—together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following a first reference label with a dash and a second label that may distinguish among the similar components. However, features discussed for various components—including those having a dash and a second reference label—apply to other similar components. If only the first reference label is used in the specification, the description is applicable to any one of the similar components having the same first reference label irrespective of the second reference label.

DETAILED DESCRIPTION

Figure 1:
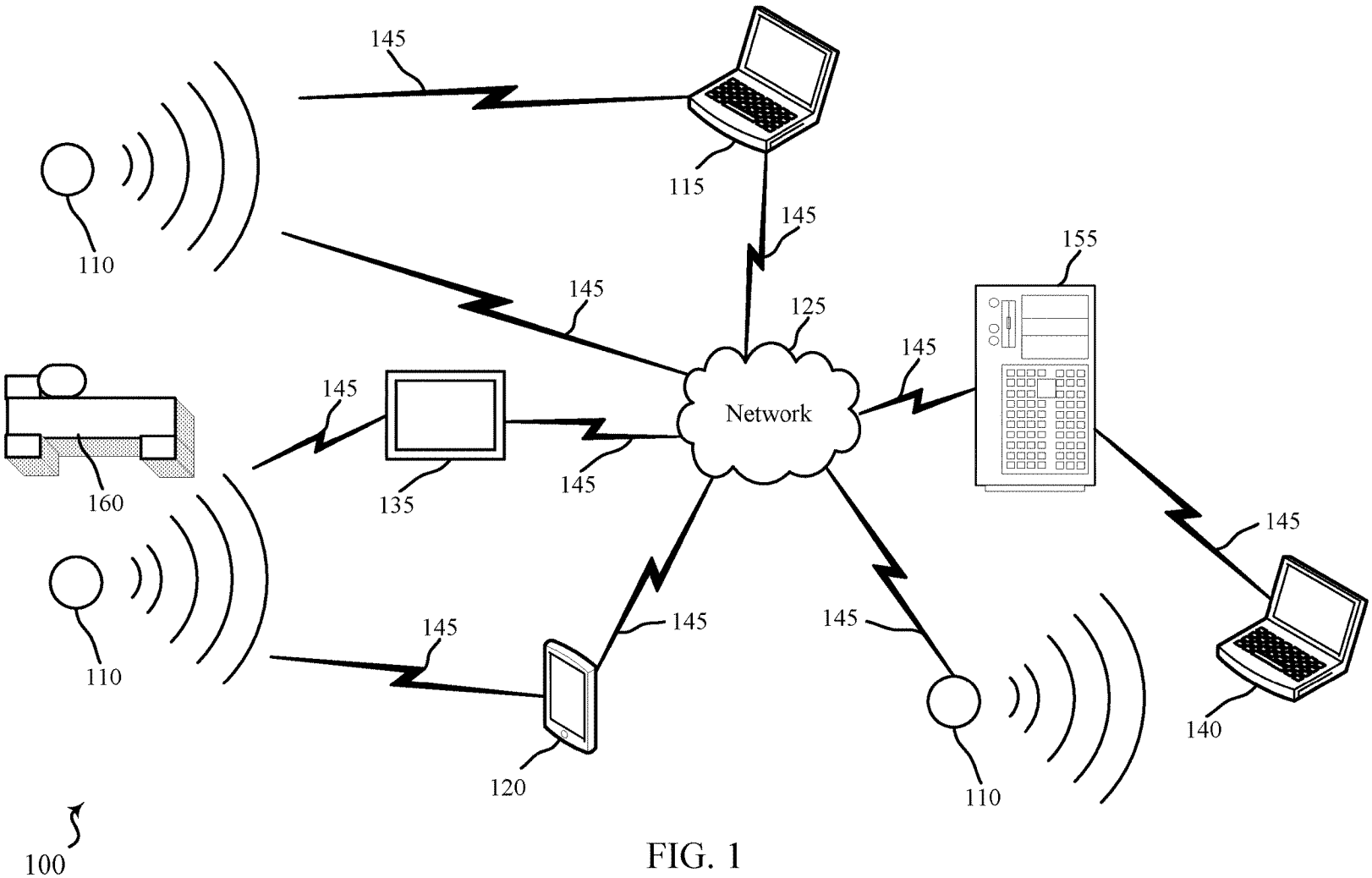
FIG. 1 is a block diagram of an example of a security and/or automation system in accordance with various embodiments.

The following relates generally to automation and/or security systems. Automation systems may include one or more sensors located in a premises, computing systems located in and/or outside of the premises, one or more control panels, speakers, microphones, etc. For example, sensors located in the premises may include sleep sensors, location sensors, occupancy sensors, camera sensors, motion sensors, proximity sensors, and/or audio sensors, among others.

An occupant may use a mobile device to monitor a premises, such as a home or a business. At the end of a day, however, an occupant of a home may have to walk to several locations of the home to make sure other occupants, such as children, spouse, visitors, etc. are in the home and that the home is secure, that certain lights are turned off and others turned on, etc. Likewise, an occupant may have to go over a checklist and walk to several locations of a business office to make sure the office is locked down and secure and that employees have left for the evening, etc. Such routines present multiple problems, including requiring considerable amounts of time to secure a premises every evening.

Aspects of the invention relate to systems, methods, and related devices for premises security and occupant tracking in conjunction with automation systems. The systems and methods may be configured to inform occupants regarding the status of a premises. For example, the systems and methods may inform parents regarding the status of their children and/or home security at a designated time. The systems and methods may help parents keep track of their children's whereabouts by tracking the location of each child and indicating the location of the child at a designated time such as a predefined bedtime. The systems and methods may monitor the status of security and automation systems, such as the status of entrance doors, windows, gates, garage doors, etc., as well as appliances and other devices associated with the premises. Thus, the systems and methods may help with securing a house for the night to ensure all children, pets, and/or other temporary and/or permanent occupants are accounted for (e.g., in bed) by a predetermined time and by monitoring the location of each person.

In one embodiment, a home automation system may learn patterns of sleep and occupancy for one or more occupants of a premises. The home automation system may employ one or more sensors. For example, sensors located at an entrance may include an image sensor, a motion sensor, a proximity sensor, an identification reader, and/or an audio sensor, among others. Sensors located within the premises may include a sleep sensor, an image sensor, a motion sensor, a proximity sensor, identification reader, an audio sensor, and/or the like, among others.

The systems and methods may include determining the location of each occupant of a premises using one or more sensors and/or based on user input. At a designated time each evening, the system may determine whether occupants are inside and/or outside a premises. The system may generate a notification indicating an occupant is outside the premises at the designated time. In some embodiments, this notification may notify a monitoring occupant (e.g., a parent) and/or a another occupant (e.g., the occupant who is outside the premises, a sibling, a babysitter, and/or others). In some embodiments, this notification may include a sound notification, a written notification, a voice notification, a tactile notification, a combination thereof, and/or other notification types.

In some cases, this notification may provide a specific location and/or a sector identifying the occupants exact location. The notification may include a prompt that allows the recipient to receive another notification upon the occupant's return to the premises. In some embodiments, this other notification, among others, can be received the next day such as when the recipient wakes up and/or at a predetermined time and/or a time the next day selected by the recipient. In some cases, a notification may include a chime. The chime may be uniquely associated with an occupant of the premises. For example, each occupant may be assigned a unique chime. Thus, upon receiving a notification the chime may sound allowing the recipient to know to whom the notification relates without having to look at the notification. In some cases, the notification may include text-to-voice notifications.

Additionally, or alternatively, the chime may be uniquely associated with a type of notification. In some embodiments, a certain chime may indicate one or more occupants is inside a premises at a certain event (including a time), outside a premises at a certain event, inside an area of a premises at a certain event, outside an area of a premises at a certain event, interacting with one or more device relating to a premises at a certain event, and/or combinations and/or variations (e.g., that one occupant is outside the premises but one occupant is inside the premises), and/or other scenarios.

In some embodiments, one or more characteristics of a chime may vary based on the scenario, including, but not limited to, varying the chime's length, pitch, pattern, tone, song, voice recording, voice notification, and/or other characteristics. A notification regarding security may include a chime unique to security-related notification, a notification regarding occupancy may include a chime unique to occupancy-related notification, and so forth. In addition, each occupant and/or monitored information may have a specific chime or notification signal.

The system may assist one or more occupants (e.g., a parent, a guardian, a responsible employee) of a premises in a nightly routine by providing a nightly summary notification. The summary notification may be based on the status of one or more automation systems, tracking systems, and/or security systems associated with the premises and its occupants. Thus, the summary notification may include a security system status, an automation system status, an occupancy status, an appliance status, a climate control status, a vehicle status, one or more occupants' statuses, and/or the like. The summary notification may appear as a single page of textual and graphical information indicating the status of each monitored system. Thus, with a glance at the summary notification, a parent may see whether a child is still outside the premises, whether a light has been left on, whether all locks are secure, whether a door is left unlocked, whether a window is left open, etc. In some cases, a summary notification may be delivered by a user's request each night, based on a preselected time, and/or based on automation data, such as sensor data. For example, a user may request a summary notification before moving to her bedroom for the evening. As another example, a user may preselect to receive a summary notification at 9:30 p.m. every evening. As yet another example, the system and/or a device may provide a summary notification based on the movement of the user receiving the notification and/or another user.

Additionally, or alternatively, the summary notification may indicate one or more characteristics of a device such as whether a media device like a television, a stereo, etc. has been left on, whether a computing device is left on, whether an appliance such as a furnace, air conditioner, refrigerator, oven, etc., is functioning properly or needs servicing, whether a vehicle is locked, whether a window is ajar, whether a door on the vehicle is left open, whether a dome light in the vehicle is left on, and the like. In some cases, the summary notification may include a prompt for the recipient to respond to predefined irregularities such as a prompt to lock a door left unlocked, whether to send a message to a child still outside the premises, whether to schedule a service call for an appliance that needs servicing, etc. In some cases, the summary notification may notify the user that one or more operations were performed based on detecting one or more irregularities, without requiring user input to correct them.

In some embodiments, the systems and methods may include determining whether an occupant is in a bedroom by the predetermined time. Thus, the summary notification may indicate that a child is in his or her bedroom by a designated bedtime. Thus, the summary notification may indicate that a child is in his or her bed by a designated bedtime. In some cases, the system may monitor a sleep parameter while the child is sleeping.

A sleep sensor may detect whether the child is awake, asleep, restless, erratically breathing, sick, cries out, etc. In some embodiments, one or more sleep sensors may be positioned within a bedroom, above a bed, below a bed, beside a bed, adjacent to a bed, on a floor, on a pillow, in a pillow, a sensor within a line of sight of a bed (e.g., a proximity sensor, an image sensor), a sensor within a line of sight of a bedroom (e.g., a motion sensor, an image sensor), on a mattress, under a mattress, integrated into a sensor housing (including flexible and/or inflexible housings), integrated into a bed, integrated into a mattress, within a separate stand-alone device, integrated with another device, present in a smart device such as a desktop computer, a laptop, a tablet, and/or a smartphone, and/or other embodiments. Upon detecting one or more sleep irregularities, such as restlessness, erratic breathing, and/or the child not being asleep by a predetermined time (e.g., via a configured time and/or a time learned by the system by monitoring and pattern detection), a notification may be generated and sent to another occupant of the premises such as a parent and/or the child relating to the sleep irregularity. In some cases, the summary notification may indicate that a child is not in his or her bedroom by the designated bedtime. When the system detects a child is not in his or her bedroom by the designated time, the system may track the location of the child and upon locating the child generate a notification with the parent as a designated recipient.

In some embodiments, the present systems and/or methods may track one or more sleep characteristics, including but not limited to irregularities, of one or more occupants. Based at least in part on the tracked information, the systems and/or methods may automatically adjust one or more system settings to ensure better sleep habits. These one or more settings may include, but are not limited to, lighting, heating, mattress characteristics, audio, power to devices, air flow (e.g., fans), recommended bed and/or awake times, recommended bedtime attire, recommended bed coverings, and/or other information.

In some embodiments, the systems and methods may include adjusting an aspect of any automation component, (e.g., a light, an electronic device, a fan, a display panel, etc.) in the premises at a predetermined time to signal a bedtime and/or based on a bedtime notification or user input (confirming bedtime). For example, if bedtime is 10:00 P.M. each evening, the system may signal bedtime at 9:50 P.M. by dimming one or more predetermined lights within the premises. In some cases, the system may adjust a brightness level of a light such as by dimming the light to a preset level and/or by turning the light on and off. If the designated light is off at the predetermined time, the system may turn the light on and then dim and/or flash the light to indicate bedtime. In some cases, the system may adjust lights in rooms where occupancy is detected. For example, one night an occupant may be in the kitchen at the designated time and a light in the kitchen may be adjusted. Another night, the same occupant may be in the family room and a light in the family room may be adjusted to indicate bedtime. In some embodiments, the system may adjust a first automation component at a first predetermined time and a second automation component at a second predetermined time, where these times may be the same and/or different.

In some embodiments, the systems and methods may include monitoring the status of automation system devices such as an automated light, door, window, lock, etc. Likewise, a functionality of an appliance, a vehicle, automation sensor, etc. may be monitored. The system may detect predefined irregularities such as an appliance taking more energy than usual based on learned patterns of behavior for the device. Thus, upon detecting an irregularity, the system may generate a notification and/or include the irregularity in a summary notification.

The following description provides examples and is not limiting of the scope, applicability, and/or examples set forth in the claims. Changes may be made in the function and/or arrangement of elements discussed without departing from the scope of the disclosure. Various examples may omit, substitute, and/or add various procedures and/or components as appropriate. For instance, the methods described may be performed in an order different from that described, and/or various steps may be added, omitted, and/or combined. Also, features described with respect to some examples may be combined in other examples. Unless otherwise specifically designated, the terms nighttime and bedtime are used interchangeably in this disclosure and use of one term should not be limited to features relating to one over the other.

FIG. 1 is an example of a communications system 100 in accordance with various aspects of the disclosure. In some embodiments, the communications system 100 may include one or more sensor units 110, local computing device 115, 120, network 125, server 155, control panel 135, and/or remote computing device 140. One or more sensor units 110 may communicate via wired or wireless communication links 145 with one or more of the local computing device 115, 120 or network 125. The network 125 may communicate via wired or wireless communication links 145 with the control panel 135 and the remote computing device 140 via server 155. In alternate embodiments, the network 125 may be integrated with any one of the local computing device 115, 120, server 155, and/or remote computing device 140, such that separate components are not required. The communications system 100 may also include, relate to, and/or function with other objects, including, but not limited to, bed 160 that may relate to one or more sensor units 110 and/or other elements of communications system 100.

Local computing device 115, 120 and remote computing device 140 may be custom computing entities configured to interact with sensor units 110 via network 125, and in some embodiments, via server 155. In other embodiments, local computing device 115, 120 and remote computing device 140 may be a personal computing device, among other things, for example, a desktop computer, a laptop computer, a netbook, a tablet personal computer (PC), a control panel, an indicator panel, a multi-site dashboard, an IPOD®, an IPAD®, a smart phone, a mobile phone, a personal digital assistant (PDA), and/or any other suitable device operable to send and receive signals, store and retrieve data, and/or execute modules.

Control panel 135 may be a smart home system panel, for example, an interactive panel mounted on a wall in a user's home. Control panel 135 may be in direct communication via wired or wireless communication links 145 with the one or more sensor units 110, or may receive sensor data from the one or more sensor units 110 via local computing devices 115, 120 and network 125, or may receive data via remote computing device 140, server 155, and network 125.

The local computing devices 115, 120 may include memory, a processor, an output, a data input and a communication module. The processor may be a general purpose processor, a Field Programmable Gate Array (FPGA), an Application Specific Integrated Circuit (ASIC), a Digital Signal Processor (DSP), and/or the like. The processor may be configured to retrieve data from and/or write data to the memory. The memory may be, for example, a random access memory (RAM), a memory buffer, a hard drive, a database, an erasable programmable read only memory (EPROM), an electrically erasable programmable read only memory (EEPROM), a read only memory (ROM), a flash memory, a hard disk, a floppy disk, cloud storage, and/or so forth. In some embodiments, the local computing devices 115, 120 may include one or more hardware-based modules (e.g., DSP, FPGA, ASIC) and/or software-based modules (e.g., a module of computer code stored at the memory and executed at the processor, a set of processor-readable instructions that may be stored at the memory and executed at the processor) associated with executing an application, such as, for example, receiving and displaying data from sensor units 110.

The processor of the local computing devices 115, 120 may be operable to control operation of the output of the local computing devices 115, 120. The output may be a television, a liquid crystal display (LCD) monitor, a cathode ray tube (CRT) monitor, speaker, tactile output device, and/or the like. In some embodiments, the output may be an integral component of the local computing devices 115, 120. Similarly stated, the output may be directly coupled to the processor. For example, the output may be the integral display of a tablet and/or smart phone. In some embodiments, an output module may include, for example, a High Definition Multimedia Interface™ (HDMI) connector, a Video Graphics Array (VGA) connector, a Universal Serial Bus™ (USB) connector, a tip, ring, sleeve (TRS) connector, and/or any other suitable connector operable to couple the local computing devices 115, 120 to the output.

The remote computing device 140 may be a computing entity operable to enable a remote user to monitor the output of the sensor units 110. The remote computing device 140 may be functionally and/or structurally similar to the local computing devices 115, 120 and may be operable to receive data streams from and/or send signals to at least one of the sensor units 110 via the network 125. The network 125 may be the Internet, an intranet, a personal area network, a local area network (LAN), a wide area network (WAN), a virtual network, a telecommunications network implemented as a wired network and/or wireless network, etc. The remote computing device 140 may receive and/or send signals over the network 125 via wireless communication links 145 and server 155.

In some embodiments, the one or more sensor units 110 may be sensors configured to conduct periodic or ongoing automatic measurements related to occupancy and/or bedtime-related data signals. Each sensor unit 110 may be capable of sensing multiple occupancy and/or bedtime-related parameters, or alternatively, separate sensor units 110 may monitor separate occupancy and/or bedtime-related parameters. For example, one sensor unit 110 may monitor occupancy (e.g., motion, image, facial recognition, voice recognition, smartphone identifier, key fob identifier, etc.), while another sensor unit 110 (or, in some embodiments, the same sensor unit 110) may detect bedtime-related parameters (e.g., bed occupancy, breathing, heart rate, rate of movement, temperature, etc.). In some embodiments, one or more sensor units 110 may additionally monitor alternate occupancy and/or bedtime-related parameters, such as occupant location outside a premises, occupant progress in a bedtime routine, etc. For example, the automation system may determine whether the occupant has finished a first task in a bedtime routine (e.g., computerized text-to-voice query, checklist displayed on a screen such as a control panel screen, monitoring movement, monitoring usage of one or more elements such as a shower, a sink, a toothbrush, etc.), and upon confirming that the first task is finished (e.g., floss teeth, etc.), may instruct the occupant to perform a second task in the bedtime routine (e.g., brush teeth, etc.), and so on. In some embodiments, sensor unit 110 may detect whether the child is awake, asleep, restless, erratically breathing, sick, cries out, etc. In some embodiments, sensor unit 110 may be positioned within a bedroom, above a bed, below a bed, beside a bed, adjacent a bed, within a line of sight of a bed, within a line of sight of a bedroom, under a mattress, integrated into a sensor housing (including flexible and/or inflexible housings), integrated into a bed, integrated into a mattress, within a separate stand-alone device, integrated with another device, present in a smart device such as a desktop computer, a laptop, a tablet, and/or a smartphone, and/or other embodiments.

Data gathered by the one or more sensor units 110 may be communicated to local computing device 115, 120, which may be, in some embodiments, a thermostat or other wall-mounted input/output smart home display, among other things. In other embodiments, local computing device 115, 120 may be a personal computer and/or smart phone. Where local computing device 115, 120 is a smart phone, the smart phone may have a dedicated application directed to collecting occupancy and bedtime-related signals and/or data and calculating location in or outside the premises, progress in a bedtime routine, sleep status, etc., therefrom. The local computing device 115, 120 may process the data received from the one or more sensor units 110 to obtain bedtime-related data. In alternate embodiments, remote computing device 140 may process the data received from the one or more sensor units 110, via network 125 and server 155, to obtain bedtime-related data. Data transmission may occur via, for example, frequencies appropriate for a personal area network (such as BLUETOOTH® or IR communications) and/or local or wide area network frequencies such as radio frequencies specified by the IEEE 802.15.4 standard, among others.

In some embodiments, local computing device 115, 120 may communicate with remote computing device 140 or control panel 135 via network 125 and server 155. Examples of networks 125 include cloud networks, local area networks (LAN), wide area networks (WAN), virtual private networks (VPN), wireless networks (using 802.11, for example), and/or cellular networks (using 3G and/or LTE, for example), etc. In some configurations, the network 125 may include the Internet. In some embodiments, a user may access the functions of local computing device 115, 120 from remote computing device 140. For example, in some embodiments, remote computing device 140 may include a mobile application that interfaces with one or more functions of local computing device 115, 120.

The server 155 may be configured to communicate with the sensor units 110, the local computing devices 115, 120, the remote computing device 140 and control panel 135. The server 155 may perform additional processing on signals received from the sensor units 110 or local computing devices 115, 120, or may simply forward the received information to the remote computing device 140 and control panel 135.

Server 155 may be a computing device operable to receive data streams (e.g., from sensor units 110 and/or local computing device 115, 120 or remote computing device 140), store and/or process data, and/or transmit data and/or data summaries (e.g., to remote computing device 140). For example, server 155 may receive a stream of occupancy data from a sensor unit 110, a stream of bedtime routine data from the same and/or a different sensor unit 110, a stream of bedtime-related data from either the same and/or yet another sensor unit 110, and a stream of sleep-related data from either the same and/or yet another sensor unit 110.

In some embodiments, server 155 may "pull" the data streams, e.g., by querying the sensor units 110, the local computing devices 115, 120, and/or the control panel 135. In some embodiments, the data streams may be "pushed" from the sensor units 110 and/or the local computing devices 115, 120 to the server 155. For example, the sensor units 110 and/or the local computing device 115, 120 may be configured to transmit data as it is generated by or entered into that device. In some instances, the sensor units 110 and/or the local computing devices 115, 120 may periodically transmit data (e.g., as a block of data or as one or more data points).

The server 155 may include a database (e.g., in memory and/or through a wired and/or a wireless connection) containing location, occupancy and/or bedtime-related data received from the sensor units 110 and/or the local computing devices 115, 120. Additionally, as described in further detail herein, software (e.g., stored in memory) may be executed on a processor of the server 155. Such software (executed on the processor) may be operable to cause the server 155 to monitor, process, summarize, present, and/or send a signal associated with resource usage data.

Figure 2:
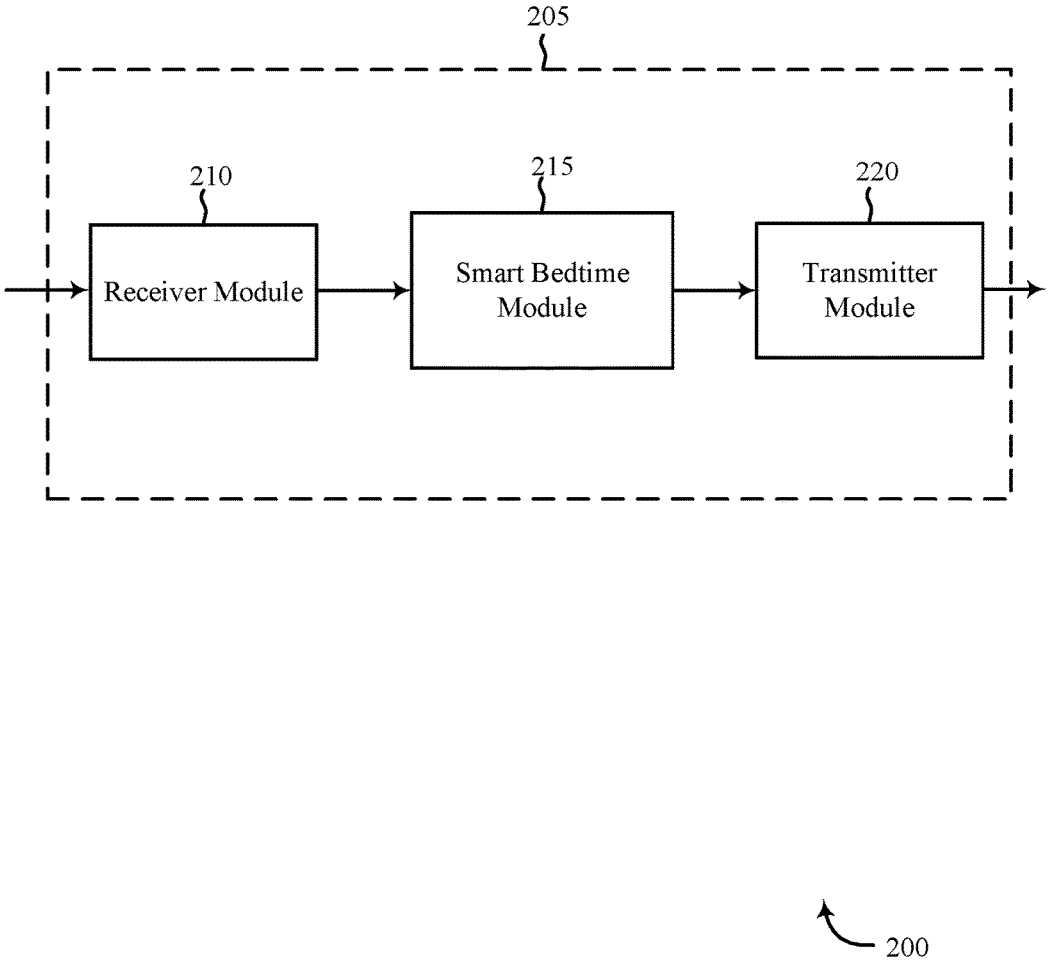
FIG. 2 shows a block diagram of a device relating to a security and/or an automation system, in accordance with various aspects of this disclosure.

FIG. 2 shows a block diagram 200 of an apparatus 205 for use in electronic communication, in accordance with various aspects of this disclosure. The apparatus 205 may be an example of one or more aspects of a control panel 135 described with reference to FIG. 1. The apparatus 205 may include a receiver module 210, a smart bedtime module 215, and/or a transmitter module 220. The apparatus 205 may also be or include a processor. Each of these modules may be in communication with each other and/or other modules—directly and/or indirectly.

The components of the apparatus 205 may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

The receiver module 210 may receive information such as packets, user data, and/or control information associated with various information channels (e.g., control channels, data channels, etc.). The receiver module 210 may be configured to receive occupancy signals and/or data (e.g., occupant is outside home, occupant is inside home, current location of occupant, etc.) and/or bedtime-related signals and/or data (e.g., occupant is awake in bed, occupant is asleep in bed, etc.). Information may be passed on to the smart bedtime module 215, and to other components of the apparatus 205.

In one embodiment, the smart bedtime module 215 may be configured to determine location, occupancy, bedtime-related, and/or sleep-related signals and/or data. The smart bedtime module 215 may include one or more processors, memory, and/or storage to assist in determining the location and/or occupancy data associated with an occupant and in monitoring and analyzing bedtime and/or sleep-related data associated with the occupant. The smart bedtime module 215 may assist in automating shutting down a premises for the night, making sure all the kids are in bed, making sure the house is secure, lights are turned off, etc. The smart bedtime module 215 may learn occupant behavior and/or routines, may be programmed with behavior and/or routines, may automatically generate one or more options for behavior and/or routines, may permit one or more users to select one or more options for behavior and/or routines, and/or may provide reminders to the occupant to perform certain nighttime tasks including but not limited to: flossing teeth, brushing teeth, turning off an appliance, gathering belongings, making a call, feeding a pet, letting a pet outside, locking a door, securing a pet door, reading, reviewing the day, writing in a journal, reviewing an agenda, making plans for tomorrow, removing makeup, washing face, personal hygiene actions, hair, removing contacts, and/or other things.

The transmitter module 220 may transmit the one or more signals received from other components of the apparatus 205. The transmitter module 220 may transmit occupancy signals and/or data (e.g., occupant is outside home, occupant is inside home, current location of occupant, etc.) and/or bedtime-related signals and/or data (e.g., occupant is awake in bed, occupant is asleep in bed, etc.). In some cases, transmitter module 220 may transmit results of data analysis on occupancy and bedtime-related signals and/or data analyzed by smart bedtime module 215. In some examples, the transmitter module 220 may be collocated with the receiver module 210 in a transceiver module. In other examples, these elements may not be collocated.

Figure 3:
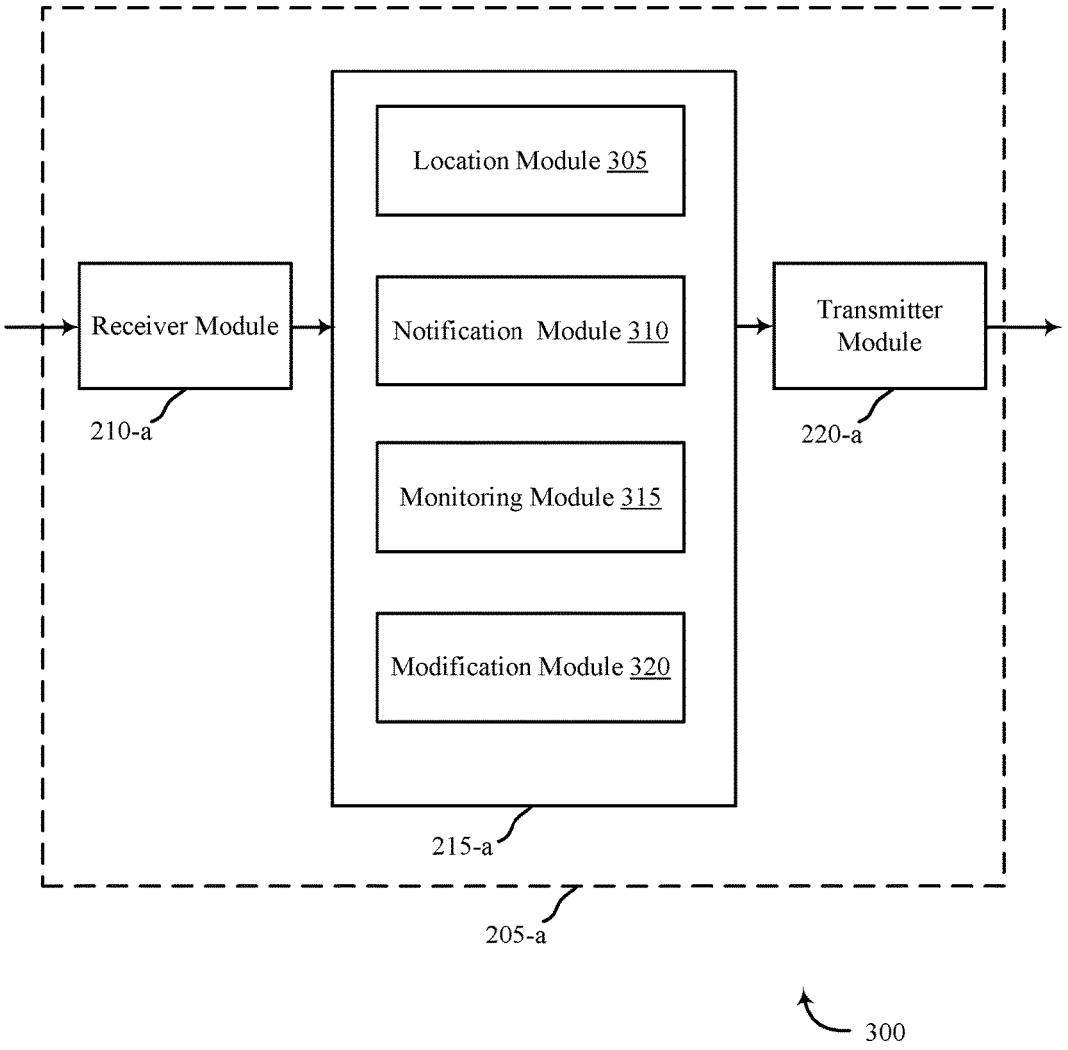
FIG. 3 shows a block diagram of a device relating to a security and/or an automation system, in accordance with various aspects of this disclosure.

FIG. 3 shows a block diagram 300 of an apparatus 205-*a* for use in wireless communication, in accordance with various examples. The apparatus 205-*a* may be an example of one or more aspects of a control panel 135 described with reference to FIG. 1. It may also be an example of an apparatus 205 described with reference to FIG. 2. The apparatus 205-*a* may include a receiver module 210-*a*, a smart bedtime module 215-*a*, and/or a transmitter module 220-*a*, which may be examples of the corresponding modules of apparatus 205. The apparatus 205-*a* may also include a processor. Each of these components may be in communication with each other. The smart bedtime module 215-*a* may include location module 305, notification module 310, monitoring module 315, and modification module 320. The receiver module 210-*a* and the transmitter module 220-*a* may perform the functions of the receiver module 210 and the transmitter module 220, of FIG. 2, respectively.

The components of the apparatus 205-*a* may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

In one embodiment, location module 305 may perform one or more functions related to the location of an occupant of a premises including receiving occupancy data, identifying characteristics of the occupancy data, and/or determining an occupant's location relative to the premises at a predetermined time. In some cases, location module 305 may communicate with an occupancy sensor to determine a location of an occupant relative to the premises. In some cases, an occupant may carry an identifier (e.g., a key fob identifier, a smartphone identifier, etc.), which may relate to the location data that enables determining the occupant's location. The location module 305 may use the identifier to assist in determining a location of an occupant and/or determine occupancy of the premises. In some cases, location module 305 may use global positioning systems (GPS) and/or local positioning systems (LPS) to determine a location of an occupant and/or determine occupancy of the premises.

In some embodiments, location module 305 may determine whether the occupant is in a bedroom by the predetermined time. Upon determining, via the location module 305, that the occupant is not in the bedroom by the predetermined time, notification module 310 may generate a notification. In some embodiments, this notification may be sent to a monitoring occupant, the occupant themselves, another occupant, and/or stored in a database and/or a remote server and later analyzed. Upon determining the occupant is in the bedroom by or after the predetermined time, monitoring module 315 may determine whether the occupant is in bed or not using one or more sensor units 110, including one or more sleep sensors, location sensors, occupancy sensors, camera sensors, motion sensors, proximity sensors, audio sensors, and/or combinations of these, among others. For example, the system may receive input from one or more sensors to help make an identification and/or a determination. In some embodiments, the system may receive input from a sleep sensor and/or an image sensor to identify and/or determine an occupant's relative position.

Upon determining the occupant is in bed, the monitoring module 315 may monitor one or more sleep parameters of the occupant. Sleep parameters may include breathing rate, weight distribution, relative position (back, right side, left side stomach), breathing pattern, heart rate, rate of movement, body temperature, room temperature, a light level in the room, etc. In some cases, monitoring module 315 may determine a level of wakefulness and/or a level of sleep such as awake, light sleep, deep sleep, etc. Upon detecting a sleep irregularity of the occupant via monitoring module 315, notification module 310 may generate a notification, among other things. The sleep irregularity may include an increase in the rate of movement indicating restlessness, a body temperature beyond a normal body temperature, an irregular room temperature, a non-ideal light level (e.g., a light level above a predetermined number of lumens, etc.), an irregular heart rate or breathing rate, etc.

In some cases, identifying characteristics of the occupancy data may include learning, via monitoring module 315, at least one of a sleep pattern and an occupancy pattern for at least one occupant of the premises. For example, monitoring module 315 may learn a sleep pattern of an occupant of the premises includes getting ready for bed at or around 10:00 P.M., going to bed at or around 10:30 P.M., occasionally waking up in the middle of the night to go to the bathroom, and waking up at or around 6:00 A.M.

As another example, monitoring module 315 may learn a weekday occupancy pattern of an occupant of the premises includes leaving the premises at or around 7:00 A.M., returning to the premises at or around 12:00 P.M., again leaving the premises at or around 1:00 P.M., and again returning to the premises at or around 6:00 P.M. Additionally, or alternatively, monitoring module 315 may learn a weekend occupancy pattern of an occupant of the premises includes occasionally leaving the premises at random times throughout the day and returning to the premises typically before 10:00 P.M. The present system and methods may use these one or more patterns and/or occupancy information to perform any operations disclosed in this disclosure.

In one embodiment, notification module 310 may generate a notification based at least in part on the location module 305 determining an occupant's location. In some cases, the notification may include an identification chime. The identification chime may be uniquely associated with a particular occupant. For example, in a premises where the occupant include a father, mother, son, and daughter, a first chime may be assigned to the father, a second chime, different from the first chime, may be assigned to the mother, a third chime, different from the first and second chimes, may be assigned to the son, and a fourth chime, different from the first, second, and third chimes, may be assigned to the daughter. Thus, when the father is away from the premises on an overnight business trip, the notification may include a chime uniquely associated with the father indicating that the father is not in the premises at a designated bedtime. In some embodiments, the present systems and methods may include disabling a chime related to one or more occupants based on received and/or known data, including data queried from an occupant. For example, the system receives information that a user will be gone for a period of time, the system may not provide a notification such as a chime during the period she will be gone. In some embodiments, the notification may include two or more selectable options. The selectable options may include at least a first option to generate a second notification upon detecting the occupant entering the premises and a second option to delay the second notification until a later time.

For example, a parent may receive a notification indicating a child is not in the premises at a designated bedtime. The notification may include an option to receive further notification the moment location module 305 detects the child entering the premises and/or an option to delay receiving further notification regarding this child until the morning. The notification may allow the parent to select a time the next morning to receive further notification (or may provide the notification based on sensor data and/or learned behavior without requiring any input from the parent) such as when one or more sensors determines that the parent wakes up the next day, when monitoring module 315 detects the parent is awake, when the monitoring module 315 detects the parent in a predetermined room such as when the parent enters the kitchen to prepare breakfast, the bathroom to get ready, etc. Thus, the parent may select the first option and receive further notification the moment location module 305 detects the child entering the premises and/or the parent may select to receive notification regarding the location of the child in the morning.

In some embodiments, notification module 310 may generate a summary notification. The summary notification may include the status of an occupant, the status of a security system, the status of an automation system, the status of a climate control system, the status of an appliance, and/or the status of a vehicle, among other things. The notification module 310 may generate the summary notification at one or more designated times (e.g., at or near a designated bed time, at or near a designated wake time, etc.), and/or when an anomaly is detected regarding the occupancy, the security system, automation system, climate control system, an appliance, and/or a vehicle. In some cases, the summary notification may be configured to fit on a single screen of a control panel, computing device, smartphone, etc. The summary notification may indicate irregularities based on monitored occupancy, monitored systems, etc. In some embodiments, the summary notification may only indicate irregularities and omit other summary-type data. The summary notification may include a unique chime associated with a type of notification such as a chime uniquely associated with occupancy, another chime uniquely associated with doors and windows, another chime uniquely associated with lights, another chime uniquely associated appliances, etc.

In one embodiment, modification module 320 may adjust an aspect of an electrically powered device at the predetermined time to signal a bedtime. Adjusting the aspect of the electrically powered device may include at least one of adjusting a brightness level, adjusting a volume level, playing a sound, and/or turning the electrically powered device on and/or off. For example, modification module 320 may adjust a brightness level of an automated light, a brightness level of a television, a sound an audio system, and play a recording of a parent's voice over a speaker system, a brightness level of a smartphone (e.g., via an installed application, via an application programming interface (API), etc.), a brightness level of a control panel, etc. In some cases, modification module 320 may adjust a volume level of a television, a volume level of a smartphone, a volume level of a radio, a volume level of a computing device, etc. Upon detecting, via monitoring module 315, an irregularity in at least one of the security system, the automation system, the climate control system, the appliance, and the vehicle, notification module 310 may include in the summary notification a prompt to adjust an aspect of the affected system, appliance, or vehicle.

In one embodiment, monitoring module 315 may monitor a status of an automated device at the premises. The automated device may include at least one of a light, a door, a window, a lock, an appliance, a computing device, and/or a vehicle, among others. Upon determining, via monitoring module 315, the status of the automated device indicates a predefined irregularity, notification module 310 may generate a notification indicating the predefined irregularity. The predefined irregularity may include a light being left on or off at a predetermined time (e.g., a predefined bedtime). In some cases, the predefined irregularity may include a door being locked or unlocked at the predetermined time, a window being left open and/or closed at the predetermined time, an appliance being left on or off at the predetermined time, and/or a computing device being left on or off at the predetermined time. Additionally, or alternatively, the predefined irregularity may include detecting a door of a vehicle being left open at the predetermined time, headlights of a vehicle being left on at the predetermined time, a dome light of a vehicle being left on at the predetermined time, etc.

Figure 4:
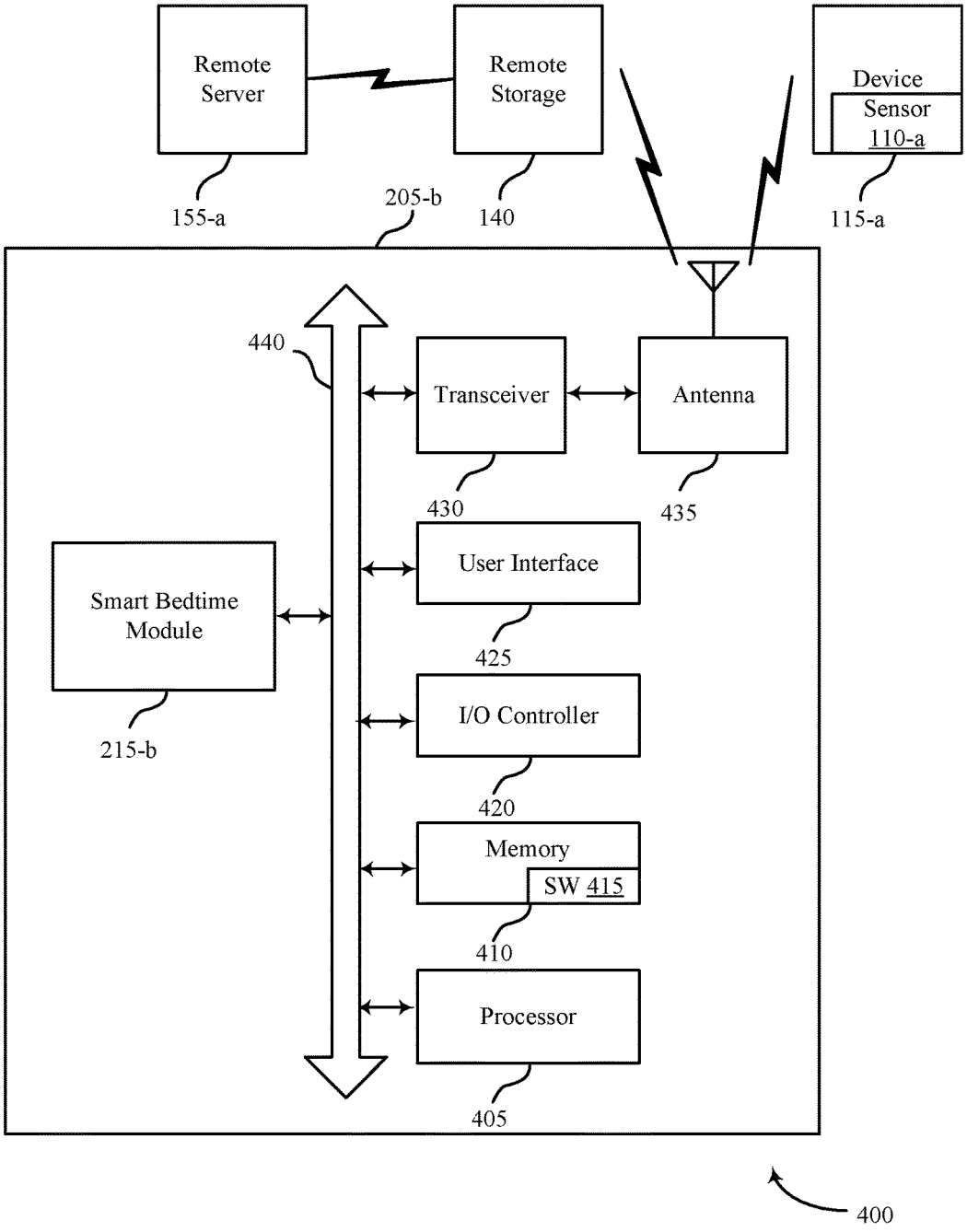
FIG. 4 shows a block diagram relating to a security and/or an automation system, in accordance with various aspects of this disclosure.

FIG. 4 shows a system 400 for use in bedtime automation systems, in accordance with various examples. System 400 may include an apparatus 205-*b*, which may be an example of the control panels 135 of FIG. 1. Apparatus 205-*b* may also be an example of one or more aspects of apparatus 205 and/or 205-*a* of FIGS. 2 and 3.

Apparatus 205-*b* may include components for bi-directional voice and data communications including components for transmitting communications and components for receiving communications. For example, apparatus 205-*b* may communicate bi-directionally with one or more of device 115-*a*, one or more sensor units 110-*a*, remote computing device 140, and/or remote server 155-*a*, which may be an example of the remote server of FIG. 1. This bi-directional communication may be direct (e.g., apparatus 205-*b* communicating directly with remote computing device 140) and/or indirect (e.g., apparatus 205-*b* communicating indirectly with remote server 155-*a* through remote computing device 140).

Apparatus 205-*b* may also include a processor module 405, and memory 410 (including software/firmware code (SW) 415), an input/output controller module 420, a user interface module 425, a transceiver module 430, and one or more antennas 435 each of which may communicate—directly or indirectly—with one another (e.g., via one or more buses 440). The transceiver module 430 may communicate bi-directionally—via the one or more antennas 435, wired links, and/or wireless links—with one or more networks or remote devices as described above. For example, the transceiver module 430 may communicate bi-directionally with one or more of device 115-*a*, remote computing device 140, and/or remote server 155-*a*. The transceiver module 430 may include a modem to modulate the packets and provide the modulated packets to the one or more antennas 435 for transmission, and to demodulate packets received from the one or more antennas 435. While a control panel or a control device (e.g., 205-*b*) may include a single antenna 435, the control panel or the control device may also have multiple antennas 435 capable of concurrently transmitting or receiving multiple wired and/or wireless transmissions. In some embodiments, one element of apparatus 205-*b* (e.g., one or more antennas 435, transceiver module 430, etc.) may provide a direct connection to a remote server 155-*a* via a direct network link to the Internet via a POP (point of presence). In some embodiments, one element of apparatus 205-*b* (e.g., one or more antennas 435, transceiver module 430, etc.) may provide a connection using wireless techniques, including digital cellular telephone connection, Cellular Digital Packet Data (CDPD) connection, digital satellite data connection, and/or another connection.

The signals associated with system 400 may include wireless communication signals such as radio frequency, electromagnetics, local area network (LAN), wide area network (WAN), virtual private network (VPN), wireless network (using 802.11, for example), 345 MHz, Z-WAVE®, cellular network (using 3G and/or LTE, for example), and/or other signals. The one or more antennas 435 and/or transceiver module 430 may include or be related to, but are not limited to, WWAN (GSM, CDMA, and WCDMA), WLAN (including BLUETOOTH® and Wi-Fi), WMAN (WiMAX), antennas for mobile communications, antennas for Wireless Personal Area Network (WPAN) applications (including RFID and UWB). In some embodiments, each antenna 435 may receive signals or information specific and/or exclusive to itself. In other embodiments, each antenna 435 may receive signals or information not specific or exclusive to itself.

In some embodiments, one or more sensor units 110-*a* (e.g., sleep, bed, occupancy, location, motion, proximity, smoke, light, glass break, door, audio, image, window, carbon monoxide, and/or another sensor) may connect to some element of system 400 via a network using one or more wired and/or wireless connections.

In some embodiments, the user interface module 425 may include an audio device, such as an external speaker system, an external display device such as a display screen, and/or an input device (e.g., remote control device interfaced with the user interface module 425 directly and/or through I/O controller module 420).

One or more buses 440 may allow data communication between one or more elements of apparatus 205-*b* (e.g., processor module 405, memory 410, I/O controller module 420, user interface module 425, etc.).

The memory 410 may include random access memory (RAM), read only memory (ROM), flash RAM, and/or other types. The memory 410 may store computer-readable, computer-executable software/firmware code 415 including instructions that, when executed, cause the processor module 405 to perform various functions described in this disclosure (e.g., monitor occupancy and bedtime-related indicators, determine a location of an occupant, and/or to determine whether to generate a notification, etc.). Alternatively, the software/firmware code 415 may not be directly executable by the processor module 405 but may cause a computer (e.g., when compiled and executed) to perform functions described herein. Alternatively, the computer-readable, computer-executable software/firmware code 415 may not be directly executable by the processor module 405 but may be configured to cause a computer (e.g., when compiled and executed) to perform functions described herein. The processor module 405 may include an intelligent hardware device, e.g., a central processing unit (CPU), a microcontroller, an application-specific integrated circuit (ASIC), etc.

In some embodiments, the memory 410 can contain, among other things, the Basic Input-Output system (BIOS) which may control basic hardware and/or software operation such as the interaction with peripheral components or devices. For example, the smart bedtime module 215 to implement the present systems and methods may be stored within the system memory 410. Applications resident with system 400 are generally stored on and accessed via a non-transitory computer readable medium, such as a hard disk drive or other storage medium. Additionally, applications can be in the form of electronic signals modulated in accordance with the application and data communication technology when accessed via a network interface (e.g., transceiver module 430, one or more antennas 435, etc.).

Many other devices and/or subsystems may be connected to one or may be included as one or more elements of system 400 (e.g., entertainment system, computing device, remote cameras, wireless key fob, wall mounted user interface device, cell radio module, battery, alarm siren, door lock, lighting system, thermostat, home appliance monitor, utility equipment monitor, and so on). In some embodiments, all of the elements shown in FIG. 4 need not be present to practice the present systems and methods. The devices and subsystems can be interconnected in different ways from that shown in FIG. 4. In some embodiments, an aspect of some operation of a system, such as that shown in FIG. 4, may be readily known in the art and are not discussed in detail in this application. Code to implement the present disclosure can be stored in a non-transitory computer-readable medium such as one or more of system memory 410 or other memory. The operating system provided on I/O controller module 420 may be iOS®, ANDROID®, MS-DOS®, MS-WINDOWS®, OS/2®, UNIX®, LINUX®, or another known operating system.

The transceiver module 430 may include a modem configured to modulate the packets and provide the modulated packets to the antennas 435 for transmission and/or to demodulate packets received from the antennas 435. While the control panel or control device (e.g., 205-*b*) may include a single antenna 435, the control panel or control device (e.g., 205-*b*) may have multiple antennas 435 capable of concurrently transmitting and/or receiving multiple wireless transmissions. The apparatus 205-*b* may include a smart bedtime module 215-*b*, which may perform any of the functions described above for the smart bedtime module 215 of apparatus 205 of FIGS. 2 and 3, including.

Figure 5:
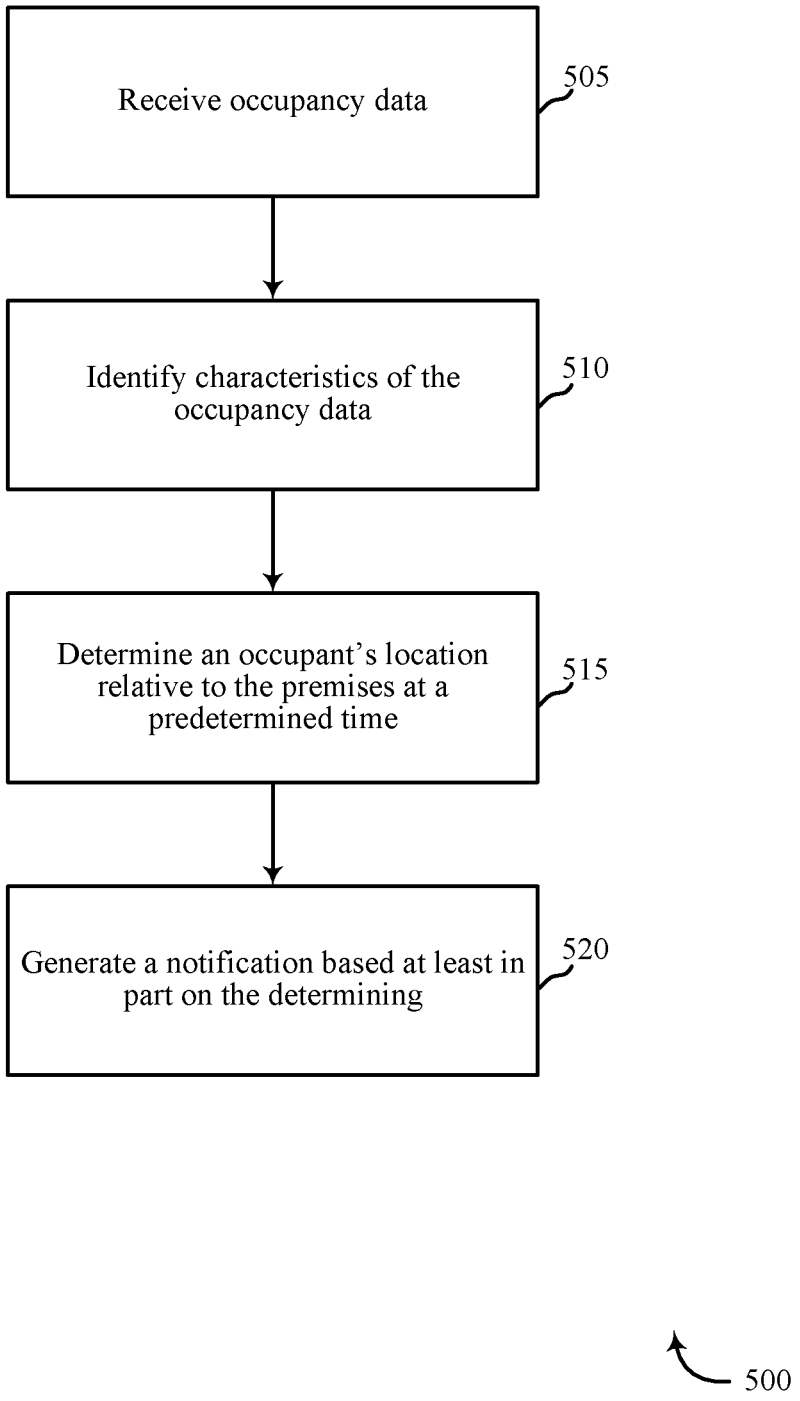
FIG. 5 is a flow chart illustrating an example of a method relating to a security and/or an automation system, in accordance with various aspects of this disclosure.

FIG. 5 is a flow chart illustrating an example of a method 500 for bedtime automation, in accordance with various aspects of the present disclosure. For clarity, the method 500 is described below with reference to aspects of one or more of the sensor units 110 described with reference to FIGS. 1-4. In some examples, a control panel, a backend server, a mobile computing device, and/or sensor(s) may execute one or more sets of codes to control the functional elements of the control panel, backend server, mobile computing device, and/or sensor to perform one or more of the functions described below. Additionally or alternatively, the control panel, backend server, mobile computing device, and/or sensor(s) may perform one or more of the functions described below using special-purpose hardware.

At block 505, occupancy data may be received. Occupancy data may be generated by one or more sensors such as sleep sensors, motion sensors, image sensors, location sensors, etc. and/or other devices. At block 510, characteristics of the occupancy data may be identified. In some cases, identifying characteristics of the occupancy data may include learning at least one of a sleep pattern, time window when certain events typically occur, pattern of events, routines, qualitative assessment, length of sleep, occupant's propensity to deviate from schedule, frequency of one or more events, etc.

and an occupancy pattern for at least one occupant of the premises. At block 515, an occupant's location relative to the premises may be determined at one or more predetermined times. At block 520, a notification based at least in part on the determining may be generated. The notification may include two or more selectable options. The selectable options may include at least a first option to generate a second notification upon detecting the occupant entering the premises and/or a second option to delay the second notification until a later time. The notification may include at least one identification chime, among other things. Each identification chime may be uniquely associated with one occupant of the premises or not.

In some cases, a summary notification may be generated. The summary notification may include one, two, or more of a status of a security system, a status of an automation system, a status of an occupant, a status of a climate control system, a status of an appliance, and/or a status of a vehicle. Upon detecting an irregularity in at least one of the security system, the automation system, the climate control system, the appliance, and/or the vehicle, the summary notification may include a prompt to adjust an aspect of the affected system, appliance, or vehicle. At least some of the operations at blocks 505-520 may be performed using the smart bedtime module 215 described with reference to FIGS. 2-4 and/or another module.

Thus, the method 500 may provide for bedtime automation relating to automation/security systems. It should be noted that the method 500 is just one implementation and that the operations of the method 500 may be rearranged, omitted, and/or otherwise modified such that other implementations are possible and contemplated.

Figure 6:
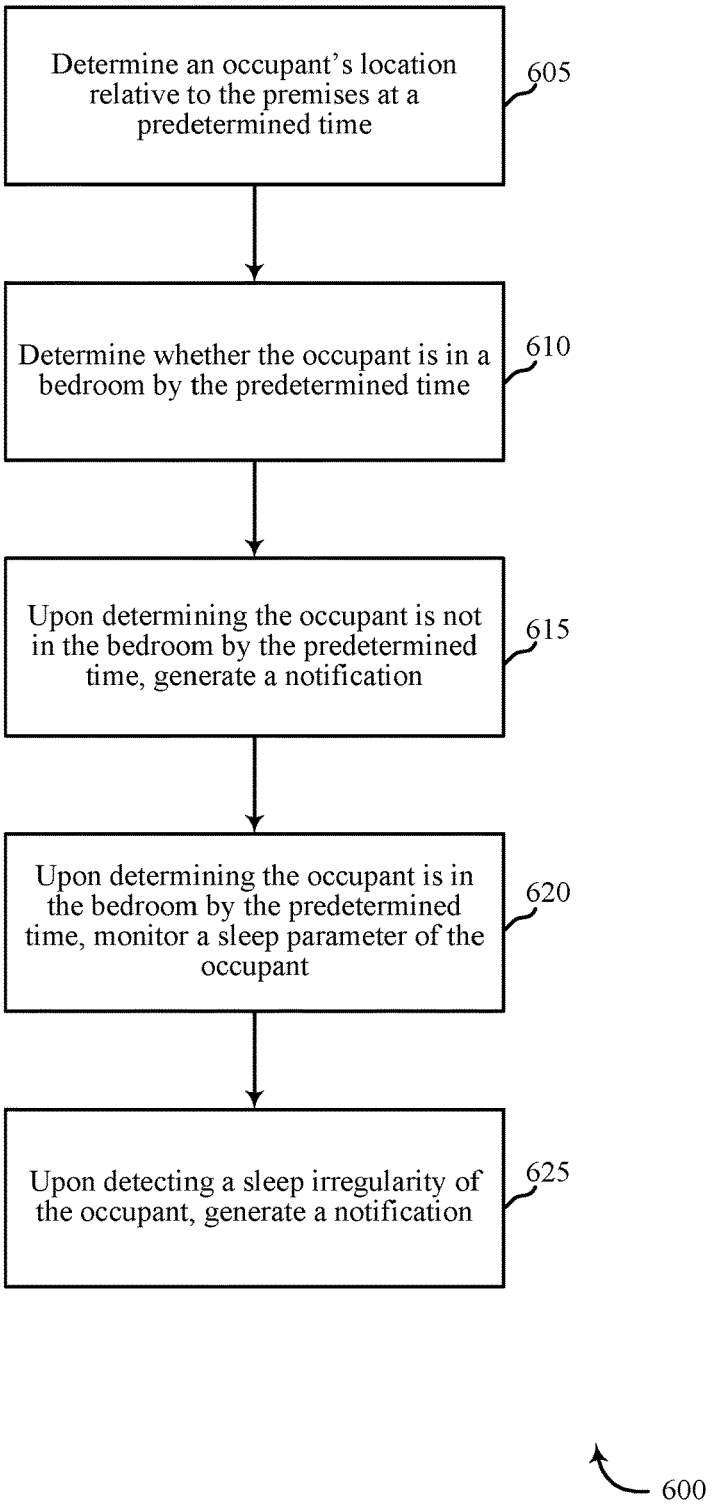
FIG. 6 is a flow chart illustrating an example of a method relating to a security and/or an automation system, in accordance with various aspects of this disclosure.

FIG. 6 is a flow chart illustrating an example of a method 600 for bedtime automation, in accordance with various aspects of the present disclosure. For clarity, the method 600 is described below with reference to aspects of one or more of the sensor units 110 described with reference to FIGS. 1-4. In some examples, a control panel, a backend server, a mobile computing device, and/or sensor(s) may execute one or more sets of codes to control the functional elements of the control panel, backend server, mobile computing device, and/or sensor to perform one or more of the functions described below. Additionally or alternatively, the control panel, backend server, mobile computing device, and/or sensor(s) may perform one or more of the functions described below using special-purpose hardware.

At block 605, an occupant's location relative to the premises at a predetermined time may be determined. At block 610, whether the occupant is in a bedroom by the predetermined time may be determined. At block 615, upon determining the occupant is not in the bedroom by the predetermined time, a notification may be generated. At block 620, upon determining the occupant is in the bedroom by, after the predetermined time, and/or within a range following the predetermined time, a sleep parameter of the occupant may be monitored. At block 625, upon detecting a sleep irregularity of the occupant, a notification may be generated. The operations at block 605-625 may be performed using the smart bedtime module 215 described with reference to FIGS. 2-4 and/or another module.

Thus, the method 600 may provide for bedtime automation relating to automation/security systems. It should be noted that the method 600 is just one implementation and that the operations of the method 600 may be rearranged, omitted, and/or otherwise modified such that other implementations are possible and contemplated.

Figure 7:
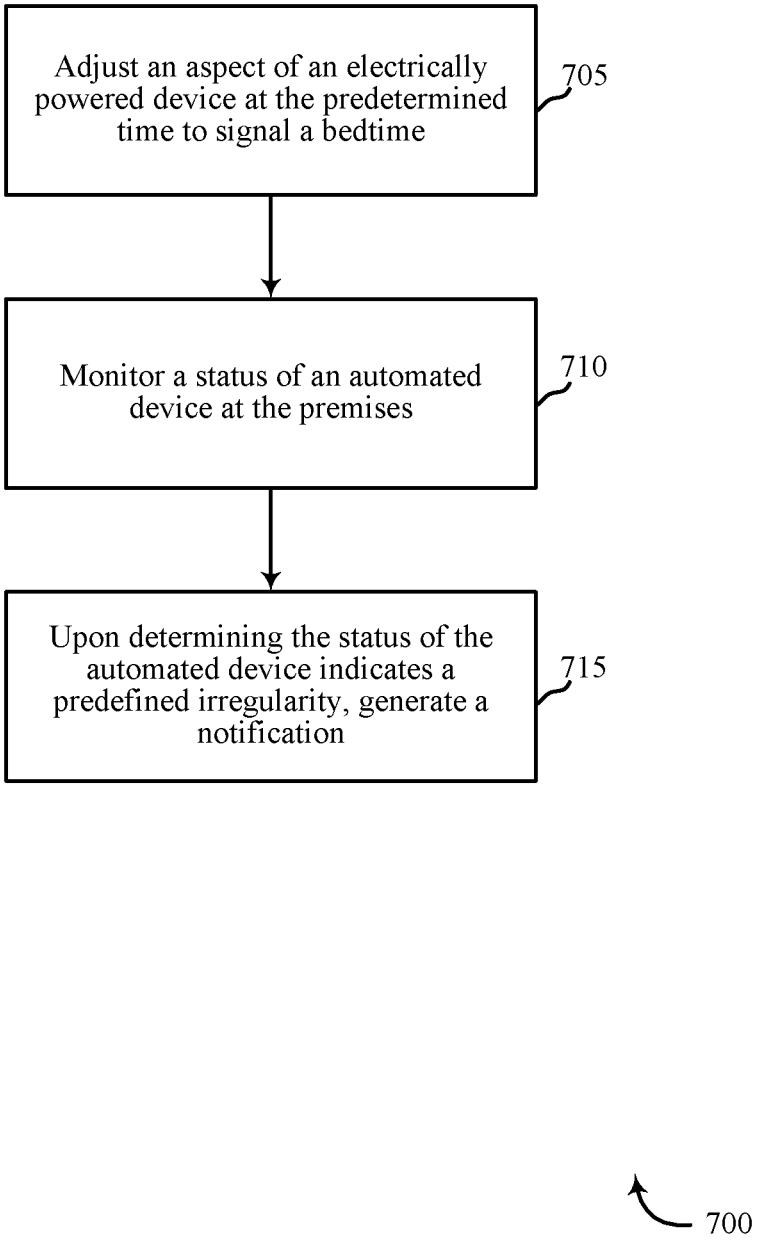
FIG. 7 is a flow chart illustrating an example of a method relating to a security and/or an automation system, in accordance with various aspects of this disclosure.

FIG. 7 is a flow chart illustrating an example of a method 700 for bedtime automation, in accordance with various aspects of the present disclosure. For clarity, the method 700 is described below with reference to aspects of one or more of the sensor units 110 described with reference to FIGS. 1-4. In some examples, a control panel, a backend server, a mobile computing device, and/or sensor(s) may execute one or more sets of codes to control the functional elements of the control panel, backend server, mobile computing device, and/or sensor to perform one or more of the functions described below. Additionally or alternatively, the control panel, backend server, mobile computing device, and/or sensor(s) may perform one or more of the functions described below using special-purpose hardware.

At block 705, an aspect of an electrically powered device at the predetermined time to signal a bedtime may be adjusted. In some cases, adjusting the aspect of the electrically powered device may include at least one of adjusting a brightness level, adjusting a volume level, playing a sound, playing an instruction, displaying a recorded video, displaying a live audio and/or video feed to one or more other devices, tuning to a channel of a radio or television, turning to an Internet channel or website, and/or turning the electrically powered device on and off. At block 710, a status of an automated device at the premises may be monitored. The automated device may include at least one of a light, a door, a window, a lock, an appliance, a computing device, and/or a vehicle, among others. At block 715, upon determining the status of the automated device indicates a predefined irregularity, a notification may be generated. The operations at block 705-715 may be performed using the smart bedtime module 215 described with reference to FIGS. 2-4 and/or another module.

Thus, the method 700 may provide for bedtime automation relating to automation/security systems. It should be noted that the method 700 is just one implementation and that the operations of the method 700 may be rearranged, omitted, and/or otherwise modified such that other implementations are possible and contemplated.

In some examples, aspects from two or more of the methods 500, 600, and 700 may be combined and/or separated. It should be noted that the methods 500, 600, and 700 are just example implementations, and that the operations of the methods 500, 600, and 700 may be rearranged or otherwise modified such that other implementations are possible.

The detailed description set forth above in connection with the appended drawings describes examples and does not represent the only instances that may be implemented or that are within the scope of the claims. The terms "example" and "exemplary," when used in this description, mean "serving as an example, instance, or illustration," and not "preferred" or "advantageous over other examples." The detailed description includes specific details for the purpose of providing an understanding of the described techniques. These techniques, however, may be practiced without these specific details. In some instances, known structures and apparatuses are shown in block diagram form in order to avoid obscuring the concepts of the described examples.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and components described in connection with this disclosure may be implemented or performed with a general-purpose processor, a digital signal processor (DSP), an ASIC, an FPGA or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, and/or state machine. A processor may also be implemented as a combination of computing devices, e.g., a combination of a DSP and a microprocessor, multiple microprocessors, one or more microprocessors in conjunction with a DSP core, and/or any other such configuration.

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope and spirit of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

As used herein, including in the claims, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

In addition, any disclosure of components contained within other components or separate from other components should be considered exemplary because multiple other architectures may potentially be implemented to achieve the same functionality, including incorporating all, most, and/or some elements as part of one or more unitary structures and/or separate structures.

Computer-readable media includes both computer storage media and communication media including any medium that facilitates transfer of a computer program from one place to another. A storage medium may be any available medium that can be accessed by a general purpose or special purpose computer. By way of example, and not limitation, computer-readable media can comprise RAM, ROM, EEPROM, flash memory, CD-ROM, DVD, or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk and Blu-ray disc where disks usually reproduce data magnetically, while discs reproduce data optically with lasers. Combinations of the above are also included within the scope of computer-readable media.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the broadest scope consistent with the principles and novel features disclosed.

This disclosure may specifically apply to security system applications. This disclosure may specifically apply to automation system applications. In some embodiments, the concepts, the technical descriptions, the features, the methods, the ideas, and/or the descriptions may specifically apply to security and/or automation system applications. Distinct advantages of such systems for these specific applications are apparent from this disclosure.

The process parameters, actions, and steps described and/or illustrated in this disclosure are given by way of example only and can be varied as desired. For example, while the steps illustrated and/or described may be shown or discussed in a particular order, these steps do not necessarily need to be performed in the order illustrated or discussed. The various exemplary methods described and/or illustrated here may also omit one or more of the steps described or illustrated here or include additional steps in addition to those disclosed.

Furthermore, while various embodiments have been described and/or illustrated here in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may permit and/or instruct a computing system to perform one or more of the exemplary embodiments disclosed here.

This description, for purposes of explanation, has been described with reference to specific embodiments. The illustrative discussions above, however, are not intended to be exhaustive or limit the present systems and methods to the precise forms discussed. Many modifications and variations are possible in view of the above teachings. The embodiments were chosen and described in order to explain the principles of the present systems and methods and their practical applications, to enable others skilled in the art to utilize the present systems, apparatus, and methods and various embodiments with various modifications as may be suited to the particular use contemplated.

What is claimed is:

1. A method for security and/or automation systems, executed by a processor, comprising:

receiving occupancy data;

identifying characteristics of the occupancy data;

determining an occupant's location relative to a premises at a predetermined time based at least in part on the identified characteristics;

determining whether an occupant is in a bedroom by the predetermined time based at least in part on the determined location;

generating a notification based at least in part on determining whether the occupant is in the bedroom at the predetermined time; and adjusting an aspect of an electrically powered device at the predetermined time to signal a bedtime, wherein adjusting the aspect of the electrically powered device includes at least one of adjusting a brightness level, adjusting a volume level, playing a sound, and turning the electrically powered device on and off.

2. The method of claim 1, wherein identifying characteristics of the occupancy data comprises:

learning at least one of a sleep pattern and an occupancy pattern for at least one occupant of the premises.

3. The method of claim 1, wherein the notification includes two or more selectable options, the selectable options including at least a first option to generate a second notification upon detecting an occupant entering the premises and a second option to delay the second notification until a later time.

4. The method of claim 1, wherein the notification includes an identification chime, the identification chime being uniquely associated with an occupant.

5. The method of claim 1, comprising:

upon determining that the occupant is not in the bedroom by the predetermined time, generating the notification.

6. The method of claim 5, comprising:

upon determining the occupant is in the bedroom by or after the predetermined time, monitoring a sleep parameter of the occupant.

7. The method of claim 6, comprising:

upon detecting a sleep irregularity of the occupant, generating the notification.

8. The method of claim 1, comprising:

generating a summary notification, the summary notification comprising two or more of a status of a security system, a status of an automation system, a status of an occupant, a status of a climate control system, a status of an appliance, and a status of a vehicle.

9. The method of claim 8, wherein the summary notification includes an indication of whether the occupant is in the bedroom at the predetermined time.

10. The method of claim 8, comprising:

upon detecting an irregularity in at least one of the security system, the automation system, the climate control system, the appliance, and the vehicle, including in the summary notification a prompt to adjust an aspect of the at least one of the security system, the automation system, the climate control system, the appliance, and the vehicle.

11. The method of claim 1, comprising:

monitoring a status of an automated device at the premises, the automated device comprising at least one of a light, a door, a window, a lock, an appliance, a computing device, and a vehicle; and upon determining the status of the automated device indicates a predefined irregularity, generating the notification.

12. An apparatus for an automation system, comprising:

a processor;

memory in electronic communication with the processor; and instructions stored in the memory, the instructions being executable by the processor to:

receive occupancy data;

identify characteristics of the occupancy data;

determine an occupant's location relative to a premises at a predetermined time based at least in part on the identified characteristics;

determine whether an occupant is in a bedroom by the predetermined time based at least in part on the determined location;

generate a notification based at least in part on determining whether the occupant is in the bedroom at the predetermined time; and adjust an aspect of an electrically powered device at the predetermined time to signal a bedtime, wherein adjusting the aspect of the electrically powered device includes at least one of adjusting a brightness level, adjusting a volume level, playing a sound, and turning the electrically powered device on and off.

13. The apparatus of claim 12, the instructions to identify characteristics of the occupancy data including instructions executable by the processor to:

learn at least one of a sleep pattern and an occupancy pattern for at least one occupant of the premises.

14. The apparatus of claim 12, wherein the notification includes two or more selectable options, the selectable options including at least a first option to generate a second notification upon detecting an occupant entering the premises and a second option to delay the second notification until a later time.

15. The apparatus of claim 12, wherein the notification includes an identification chime, the identification chime being uniquely associated with an occupant.

16. The apparatus of claim 15, the instructions being executable by the processor to:

generate the notification upon determining the occupant is not in the bedroom by the predetermined time.

17. The apparatus of claim 15, the instructions being executable by the processor to:

monitor a sleep parameter of the occupant upon determining the occupant is in the bedroom by or after the predetermined time.

18. The apparatus of claim 12, the instructions being executable by the processor to:

generate a summary notification, the summary notification comprising an indication of whether the occupant is in the bedroom at the predetermined time, and two or more of a status of a security system, a status of an automation system, a status of an occupant, a status of a climate control system, a status of an appliance, and a status of a vehicle.

19. A non-transitory computer-readable medium storing computer-executable code for an automation system, the code executable by a processor to:

receive occupancy data;

identify characteristics of the occupancy data;

determine an occupant's location relative to a premises at a predetermined time based at least in part on the identified characteristics;

determine whether an occupant is in a bedroom by the predetermined time based at least in part on the determined location;

generate a notification based at least in part on determining whether the occupant is in the bedroom at the predetermined time; and adjust an aspect of an electrically powered device at the predetermined time to signal a bedtime, wherein adjusting the aspect of the electrically powered device includes at least one of adjusting a brightness level, adjusting a volume level, playing a sound, and turning the electrically powered device on and off.

* * * * *